US005333936A

United States Patent [19]

Zitz

[11] Patent Number: 5,333,936

[45] Date of Patent: Aug. 2, 1994

[54] LOW PROFILE MINING MACHINE HAVING A CUTTER MOUNTED ON A SLIDABLE CARRIAGE

[75] Inventor: Alfred Zitz, Zeltweg, Austria

[73] Assignee: Voest-Alpine Bergtechnik Gesellschaft m.b.H., Zeltweg, Austria

[21] Appl. No.: 2,487

[22] Filed: Jan. 8, 1993

[30] Foreign Application Priority Data

Jan. 10, 1992 [AT] Austria ..... A 31/92

[51] Int. Cl.[5] ..... E21C 27/24; E21C 35/20

[52] U.S. Cl. ..... 299/64; 299/31; 299/75

[58] Field of Search ..... 299/33, 64, 66, 73, 299/75, 31

[56] References Cited

U.S. PATENT DOCUMENTS

| | | | |
|---|---|---|---|
| 3,876,252 | 4/1975 | Cilles | 299/64 X |
| 4,133,582 | 1/1979 | Kogelmann | 299/64 |
| 5,072,994 | 12/1991 | Brandl et al. | 299/67 |

FOREIGN PATENT DOCUMENTS

| | | | |
|---|---|---|---|
| 392512 | 4/1991 | Austria . | |
| 647447 | 2/1979 | U.S.S.R. | 299/64 |
| 0043812 | 1/1982 | U.S.S.R. | 299/64 |
| 1207810 | 10/1970 | United Kingdom | 299/64 |
| 1587755 | 4/1981 | United Kingdom . | |

*Primary Examiner*—David J. Bagnell

*Attorney, Agent, or Firm*—Cushman, Darby & Cushman

[57] ABSTRACT

A cutter machine has cutter heads or rollers rotatably mounted on a pivoting cutter arm. It also has a loading ramp and a conveyor running in a direction towards the work face of the cutter machine to take up and convey away cut material. The cutter arm is mounted on a sliding carriage which is displaceable along guides running in the longitudinal direction of the machine. The carriage is configured as a self-supporting box profile in a clear cross-section space of which a removal conveyor is mounted so that it may slide. For this reason, the cutter machine is particularly well-suited for use in small seam heights and for particularly low constructional design. It may nonetheless be used satisfactorily for operating reliably over a variable tunnel width.

17 Claims, 5 Drawing Sheets

LOW PROFILE MINING MACHINE HAVING A CUTTER MOUNTED ON A SLIDABLE CARRIAGE

BACKGROUND OF THE INVENTION

1. Field of the Invention

The present invention relates to a cutter machine having cutting heads or rollers rotatably mounted on a pivoting cutter arm and with a loading ramp and a conveyor running in a direction towards the work face for taking up and conveying away cut material, in which the cutter arm is mounted on a sliding carriage which is displaceable along guides running in the longitudinal direction of the machine.

2. Description of the Related Art

Cutter machines of the type initially referred to are known, for example, from AT-PS 392 512. An additional cutter machine of the type initially referred to is known, for example, from AT-PS 393 295. In the case of these known types of equipment, to simplify the probing into the work face, a displacement of the cutter arm along guides running in the longitudinal direction of the machine was made possible, in which case the stresses to be taken up by these guides with their appropriate bearing components generally required a relatively large structural height.

SUMMARY OF THE INVENTION

The aim of the present invention is therefore to develop a cutter machine of the type initially referred to in such a manner that it may be utilised even for small seam heights and in the case of particularly low constructional design, it may nonetheless be satisfactorily used for operating reliably over a variable width of tunnel. Lastly, the machine in accordance with the present invention must provide the possibility, if such should be required, of shoring up the tunnel with bores for anchors and setting devices close to the work face, in which case the prerequisite is that, not only the constructional height of the machine in the region close to the work face should be as small as possible in order to make possible the unhindered employment of boring devices for anchors and setting devices, but also, despite great tunnel lengths, there is still sufficient space alongside the machine to allow for the bringing in of timbering supports.

For achievement of these aims, the present cutter machine is designed so that the carriage is a self-supporting box profile, in the clear inside width of which the conveyor is mounted so that it may slide along freely. Because of the fact that the carriage is designed as a self-supporting box profile, it is possible to dispense with a suitably solid and bulky base framework. The crawler treads of the full-track vehicle may be combined in an appropriate manner with the guides for the carriage and, by taking into consideration the self-supporting construction of the carriage, there will be lesser demands made upon the mechanical strength of the component parts of the full-track vehicle. Because a box profile is utilised, it is also possible to select a substantially smaller constructional height of the carriage on the basis of the self-contained box profile than would be the case with already known constructions. By way of example, it is already known that the removal conveyor may be housed in a tunnel-shaped component which surrounds the conveyor, and the pivoting mechanism for the cutter arm is affixed to this component. This type of tunnel-shaped design, when taking into account the absorption of the high reaction forces developed by the cutting operations, requires a correspondingly high constructional height, for the reason that such a type of tunnel-shaped construction cannot be compared statically with a self-contained box profile construction. Furthermore, this type of tunnel-shaped construction, if it were designed to be displaceable in the longitudinal direction of the cutter machine, would require a correspondingly massive base framework, in which case the reaction forces of the bearing on the relatively high overhead walls of such a tunnel-shaped profile would exert strong forces on the guides for the displaceability of such a type of carriage. Overall, because of the configuration of the carriage as a self-supporting box profile, there arises the prerequisite and possibility of providing a particularly low construction as the carriage which, taking into consideration the relatively lower stresses on the tracks, can be set down relatively deeply, so that overall a very small constructional height may be achieved.

In an advantageous manner, the configuration in accordance with the present invention is designed in such a way that the pivot axes of the pivot arm for height pivoting and, if necessary for lateral pivoting, can extend within the clear inside cross-section of the box profile or else may cross over or intersect within the clear inside cross-section of the box profile. Such a configuration makes it possible to arrange the bearing components for the cutter arm also within the self-supporting box profile, by which means on the one hand there is a saving in construction height and, on the other hand, there is achieved an improvement of the force absorption by the bearing. Deviating from known types of tunnel constructions or table constructions, it is actually possible for the vertical pivot axis, that is to say the pivot axis for the horizontal movement of the cantilever arm, to be mounted not only in the upper but also in the lower transverse wall of the self-supporting box profile, for which reason, without increasing the constructional height, reliable absorption of forces is ensured, even with great tunnel lengths and relatively narrow rail constructions.

It is advantageous for the inventive cutter machine to be developed further in such a way that the bearing component carrying the bearing for the pivoting in the lateral direction is formed by a box profile enclosing the conveyor, which is pivotally mounted in the lower and upper wall of the box profile of the carriage. This type of box profile itself provides an adequately large inside cross-section for the free passage of the conveyor and offers the simple constructive configuration of a reliable mounting for the lateral pivoting of the cantilever arm with simultaneous provision of an enclosed and protected space for the removal conveyor and also for the drive mechanism for the pivoting movements of the cutter arm. Above all things, the enclosed profile construction offers the additional possibility of attachment of suction means for dust removal, and this once again is favourable for extension work to safeguard the roof, because it is no longer hindered by excessive dust production.

An especially compact design is achieved if the side walls or the cover plates of the bearing component surrounding the conveyor carry the bearings for the height pivoting of the pivot arm, in which case the cutter arm or the box profile of the axis for height pivoting possesses angled arms, projecting into the free cross-section space of the box profile of the carriage, which are articulated with the height drive mechanism, especially hydraulic cylinder-piston aggregates. In particular, such a configuration of the cutter arm having angled arms projecting into the interior of the box profile makes it possible to arrange not only the pivot drive mechanism for the horizontal pivoting of the cutter arm, which naturally must engage with the bearing component by articulation, but also the pivot arm for the height pivoting of the cutter arm in a reliable manner within the box profile which forms the self-supporting carriage. Such a type of design naturally leads to substantially improved protection of the drive mechanism aggregate for pivoting the cutter arm. It is an advantage here for the design to be such that the pivot drive for height pivoting, and optionally lateral pivoting, is comprised of cylinder-piston aggregates extending in the longitudinal direction of the machine.

As previously mentioned, taking into consideration the design of the carriage as a self-supporting box profile, a frame of only limited rigidity is required as the machine frame or vehicle frame. To avoid static overspecification and especially to reduce over-stressing of the guides for the carriage, the design is arranged in such a manner that a framework connecting the tracks is made up of frame components articulated with the tracks.

The sliding mounting of the removal conveyor within the free clear cross-section space of the self-supporting box profile of the carriage offers the possibility in a simple fashion to achieve a coupling of the displacement movement of the conveyor with the displacement movement of the cutter arm. The cutter arm is moved up to the work face by displacement of the carriage in the longitudinal direction of the cutter machine, or else it is pulled back from this, position, and in a preferred embodiment of the invention, the conveyor is displaceable to a limited extent in the longitudinal direction within the free cross-section space of the carriage, in which case the conveyor in particular is mounted to be displaceable in the longitudinal direction on a guide of the carriage, and at the same time the advantage is derived that an appropriate offset follow-up of the conveyor is established for the satisfactory removal of material cut from the work face.

An extremely simple and operationally reliable design of the guides for the carriage which is configured as a self-supporting box profile may be achieved by having the carriage guides connected to the tracks formed from bars enclosed within the carriage. The drive mechanism for the displacement of such a carriage may be provided in a conventional manner by a cylinder-piston aggregate arranged in the longitudinal direction of the machine, where this aggregate is disposed on the underside of the self-supporting box profile and is protected by it.

As already mentioned, the carriage configured as a self-supporting box profile, on the basis of a closed construction, offers the possibility that a suction device may be linked to the clear cross-section space of the self-supporting box profile, where additional ventilation devices and equipment for settling of dust and for cooling the work face could naturally also be introduced into the clear cross-section space.

BRIEF DESCRIPTION OF THE DRAWINGS

The invention will now be described in greater detail with reference to examples of embodiment depicted in the accompanying drawings, in which.

DETAILED DESCRIPTION OF THE PRESENTLY PREFERRED EXEMPLARY EMBODIMENTS

Figure 1:
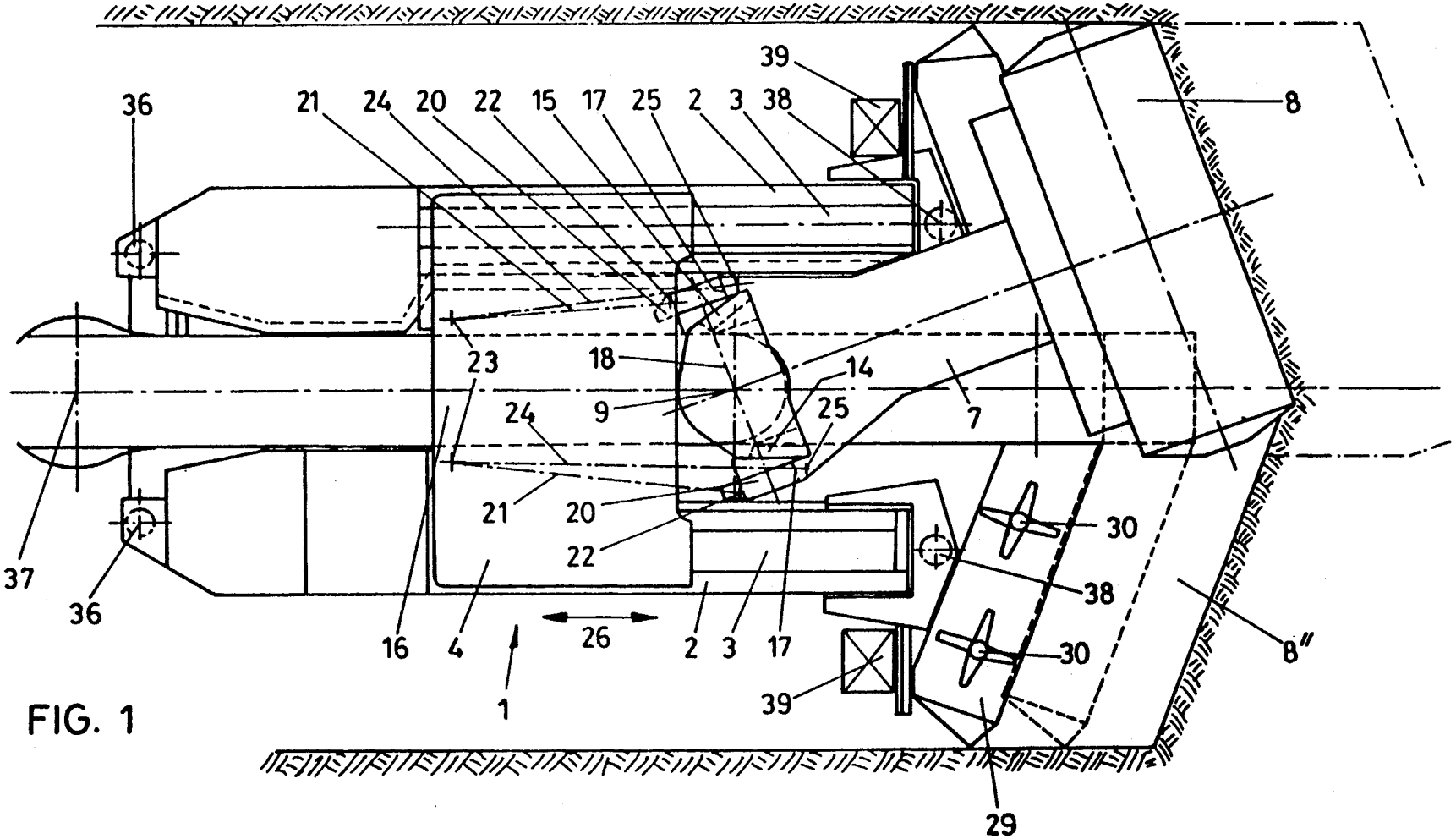
FIG. 1 is a plan view of a cutter machine in accordance with the present invention.
Figure 2:
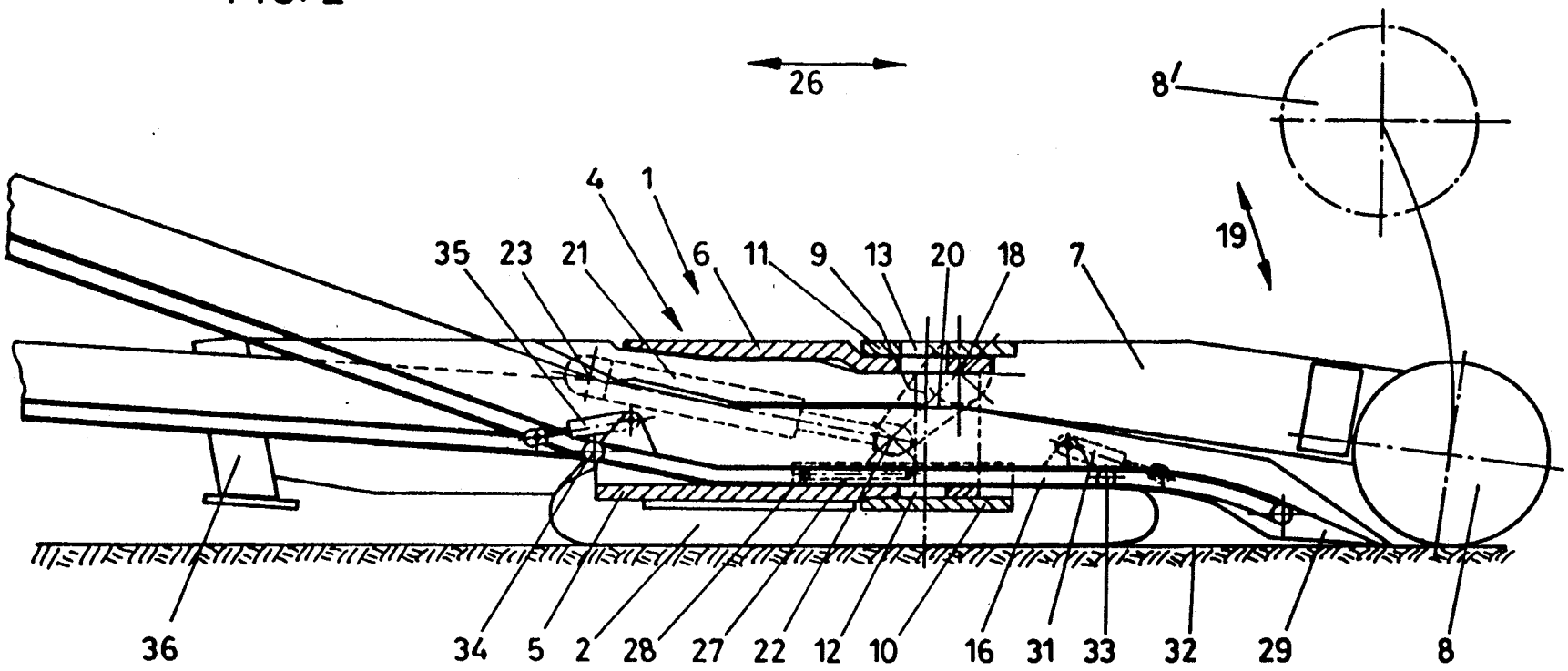
FIG. 2 is a side elevation, partly in section, of a cutter machine in accordance with the present invention.

The cutter machine 1 depicted in FIGS. 1 and 2 may be moved along on tracks 2, where a carriage formed from a box profile 4 connected to the tracks 2 is mounted to be displaceable along guides 3 running in the longitudinal direction of the machine. In FIG. 2 the carriage 4 is shown in longitudinal section where the base plate is designated as 5 and the cover plate as 6. Mounted on the carriage 4 formed from a box profile, there is a cutter arm 7 which may be pivoted both in height and sideways and which carries a cutter roller 8 in the embodiment depicted. The raised position of the cutter roller is designated as 8' in FIG. 2, whereas in FIG. 1 the two end positions of the cutter roller when pivoted sideways are designated as 8 and 8''.

For pivoting the cutter arm 7 with the cutter roller 8 in the sideways direction, that is to say around the vertical axis 9, bearing components 10 and 11 act in conjunction with the upper and lower delimiting walls 5 and 6 (FIG. 2) of the carriage 4, where bolt connections in the carriage or in the lower and upper walls 5 and 6 respectively are designated as 12 and 13. The bearing components 10 and 11 are connected together by bearers 14 and 15 disposed at right angles thereto, so here also the result is a substantially box-shaped profile as the complete bearing component for the sideways pivoting of the cutter arm 7 which, similar to the box profile of the carriage 4, surrounds the conveyor 16 which is guided within the carriage. Bearings 17 in both side walls are provided in the components or side elements 14 and 15 of the bearing components for a pivoting of the cutter arm 7 about the substantially horizontal axis 18.

The pivoting of the cantilever arm 7 corresponding to the double-headed arrow 19 in FIG. 2 is effected here by way of a cylinder-piston aggregate 21 attached to an angled arm 20 which, at 22 on the angled arm involved and at 23, is articulated with the end of the carriage facing away from the cutter arm 7. The cylinders for the height pivoting of the cutter arm are depicted in FIG. 1 by their central middle lines which are also designated as 21. The pivoting of the cutter arm 7 in the sideways direction, that is to say about the substantially vertical axis 8, is also effected by cylinder-piston aggregates, which are designated in FIG. 1 by their middle lines 24. The cylinder-piston aggregates 24, in the depicted embodiment, are also articulated with the rear of the carriage, that is to say in the region of the carriage 4 facing away from the cutter arm 7, and articulated at 25 with the bearing component carrying the cutter arm 7. Because of the arrangement of the pivot axes 9 and 18 and their cross-over point inside, that is to say in the clear width of the carriage 4, the overall result is a very small constructional height of the entire machine.

The carriage 4 formed from a self-supporting box profile may be displaced along guides 3 in the direction shown by the double-headed arrow 26 in the longitudinal direction of the machine by means of a cylinder-piston aggregate for example (not depicted for the sake of clarity), providing the drive mechanism, thus enabling digging into the work face by displacement of the cutter arm 7 with the cutter roller 8, without alteration of the position of the tracks 2. Here also, the conveyor 16 which is located within the clear cross-section space of the carriage may be displaced in the direction shown by the double-headed arrow 26, in which case a guide 27 is provided between the carriage and the frame of the conveyor 16, where a bolt 28 is inserted into the elongated slot in the carriage as indicated in FIG. 2. Because of the guide, the effect is achieved that, with a first displacement of the carriage 4 in the direction towards the work face, the conveyor 16 and the loading ramp 29 connected to the conveyor remain in an unchanged position, whereas it is only after subsequent further displacement and digging into the work face by the cutter roller that the conveyor 16, together with the loading ramp 29, is pulled along. The length of the elongated slot 27 corresponds substantially to the depth of digging-in by the cutter roller so that, when the digging into the work face takes place in the region of the roof, the entire work face can be cut into and it is only after a further digging-in operation that the loading ramp, together with the conveyor, can also be pulled along also by the further displacement of the carriage into the free space which has been created in the meantime by the excavation.

There are loading impeller blades 30 provided on the loading ramp 29 which transfer the excavated material directly onto the conveyor 16. The loading ramp may be raised up from the floor 32 of the tunnel by means of the cylinder-piston aggregate 31 shown diagrammatically in FIG. 2 where an articulation joint 33 is indicated. In the region of the carriage facing away from the cutter arm 7, the conveyor 16 has an additional articulation joint 34 so that the delivery end (not shown in detail) of the conveyor may also be raised up by means of an additional cylinder-piston aggregate 35. In the region of the rear end of the machine a support 36 is indicated where, in addition to height pivoting of the delivery end of the conveyor, this may also be moved sideways, as indicated by the articulation joint 37 in FIG. 1. In addition to a support in the region of the rear end, the machine may also be supported in its forward region, that is to say immediately before the tracks 2, by means of the supports 38. Anchor boring and setting equipment 39 is also provided in this region as indicated.

Figure 3:
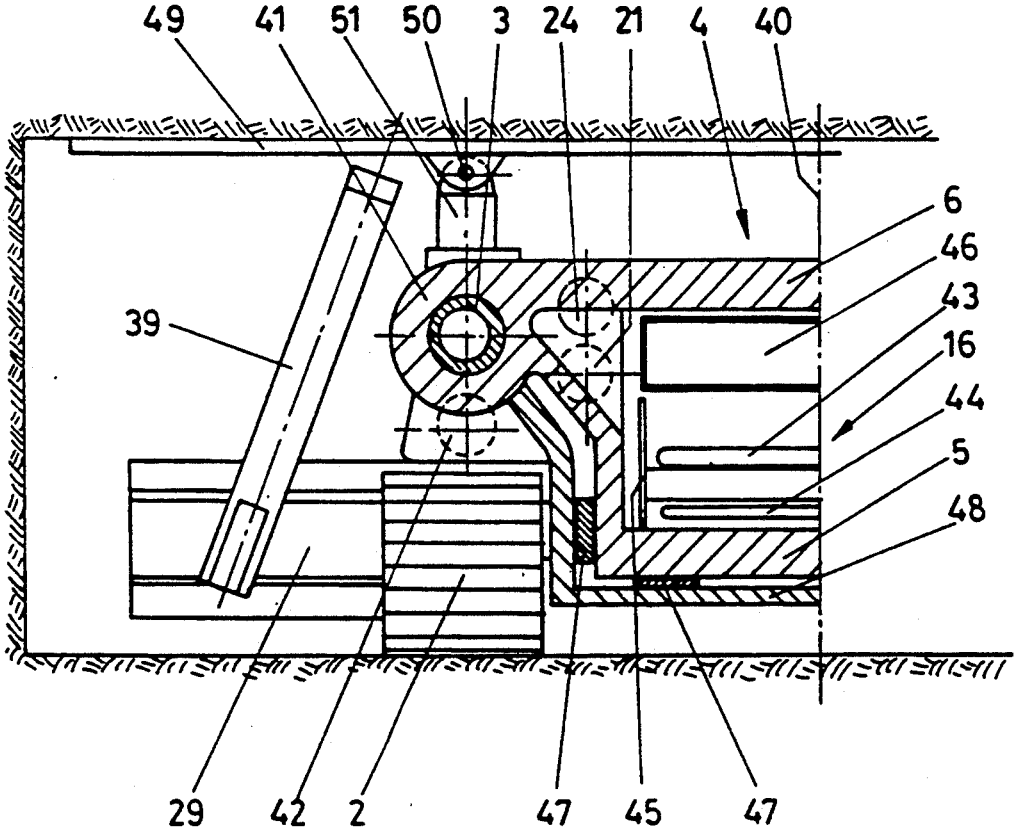
FIG. 3 is a rear view, on an enlarged scale, of the suspension of the carriage formed from a box profile on the tracks of the cutter machine in accordance with the present invention.
Figure 4:
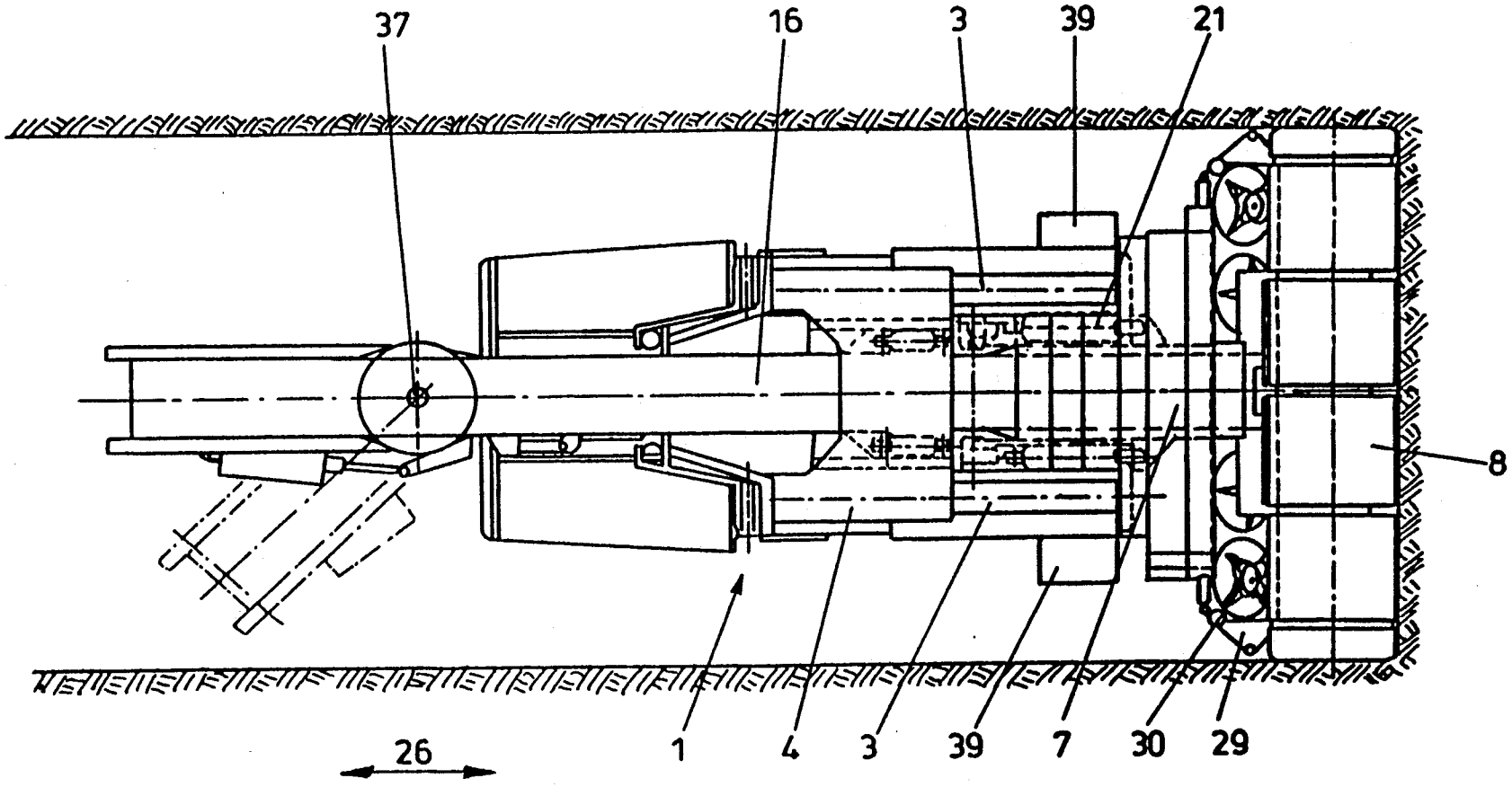
FIG. 4 is a plan view analogous to FIG. 1 of a cutter machine modified in accordance with the present invention.

In the diagrammatic representation in FIG. 3, only one half of the cutter machine is shown partly in section as seen from the rear, where the middle line of the machine is designated as 40. The carriage 4 formed from a self-supporting box profile, the lower delimiting wall of which is again designated as 5 and the upper delimiting wall is designated as 6, is mounted on the guides 3 which are connected to the tracks 2, where the guides 3 are formed from bars extending in the longitudinal direction of the machine, said bars being gripped in corresponding bearing eyes 41 provided on the carriage. In FIG. 3 the drive mechanism for the carriage displacement in the longitudinal direction of the machine is designated as 42. In a similar way the arrangement is indicated of the hydraulic cylinder-piston aggregate 21 and 24 located for protection within the lateral region of the carriage 4. The box profile of the carriage 4 completely encloses the conveyor 16, the top run of which is designated as 43 and the bottom run as 44. The conveyor is thus located in a closed space delimited by side walls 45, and at the top by another closed space 46 to which a suction device is attached at the rear end of the machine. This suction space 46 is extended by way of an appropriate suction duct inside the cutter arm close to the immediate vicinity of the cutter roller 8.

The carriage 4 is mounted by means of slide blocks or slide guides 47 on a connecting frame 48, where this connecting frame 48 represents either an articulated connection between the tracks or else may be configured as a very light-weight welded construction, because the carrier function is substantially provided by the carriage 4 and solely the force transmission to the tracks is substantially effected by way of the guides 3 and also by bearing surfaces on the frame elements of the connecting frame 48.

Furthermore in FIG. 3, anchor boring and setting equipment 39 is indicated and there is also a terminal support 49 indicated on the roof which is connected by means of an articulated joint 50 with appropriate lifting props 51.

A penetration by the cutter roller 8 due to displacement of the carriage 4 in the forward direction of the machine is effected especially when the cutter roller is in a sloping position as indicated in FIG. 1. In this way it is possible to avoid problems which would arise from drive ribs, because a sloping penetration automatically eliminates these ribs, which is advantageous, especially in the cutting of harder and tougher coal.

In the case of the modified embodiments of a cutter machine 1 depicted in FIGS. 4 to 7, the same reference numbers for similar components are used as in the preceding embodiments. The second embodiment of a cutter machine 1 differs from the embodiment depicted in FIGS. 1 to 3 owing to the fact that in this embodiment the height pivoting cantilever arm 7 carries only one cutter roller 8 which extends over the entire width of the work face to be excavated. Therefore there is no need to provide a pivot mechanism in this second embodiment for pivoting of the cantilever or cutting arm 7 arm about a substantially vertical axis and the cantilever arm is only pivoted in the direction indicated by the double-headed arrow 19 in FIG. 6 about the substantially horizontal axis which is again designated as 18. In addition, in this modified embodiment an angled arm 20 is connected directly to the carriage 4 formed from the box profile, in which case a cylinder-piston aggregate 21 is attached by an articulated joint for the raising and lowering of the cantilever arm 7. The articulation sites on the angled arm 20 and the cantilever arm 7 are respectively designated as 52 and 53 in FIG. 6.

Figure 7:
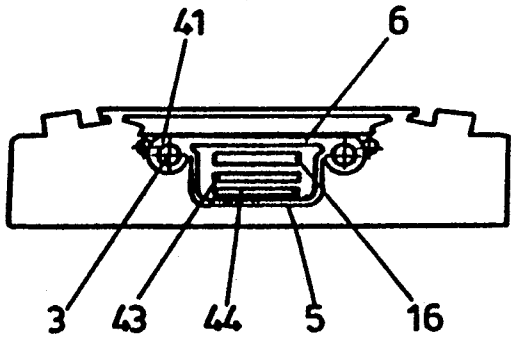
FIG. 7 is a section along line VII—VII in FIG. 6.
Figure 6:
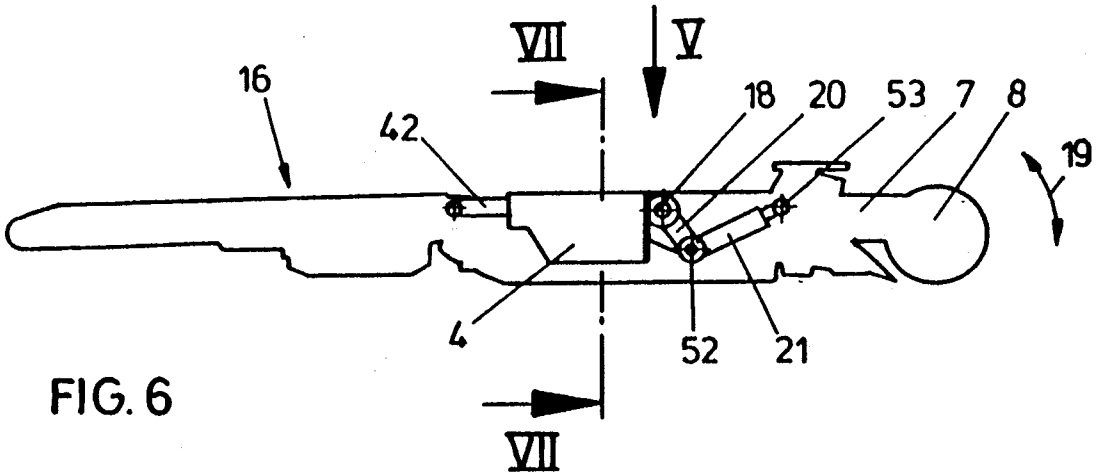
FIG. 6 is a side elevation in the direction of the arrow VI in FIG. 5 which is a plan in the direction of arrow V shown in FIG. 6.
Figure 5:
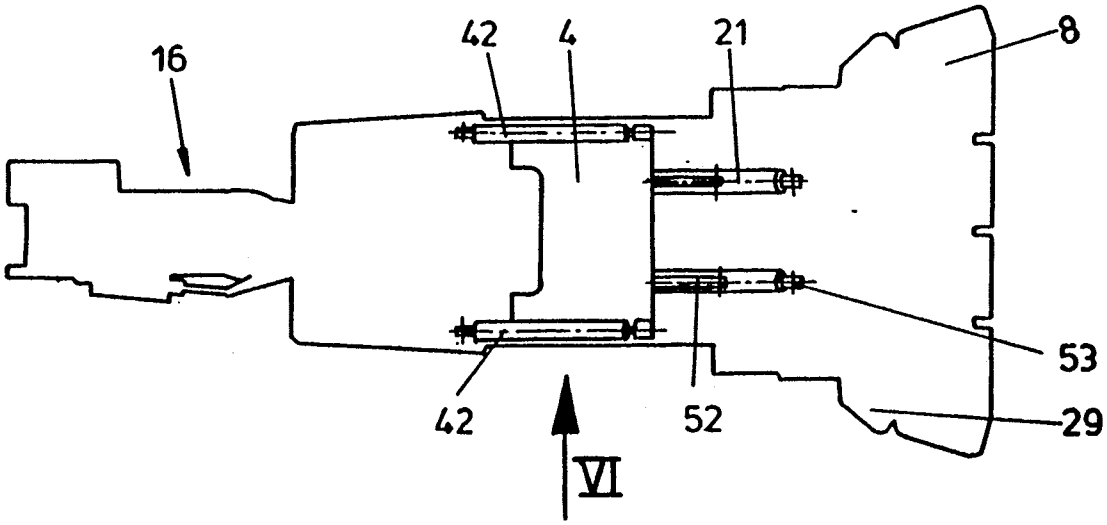
FIG. 5 is a diagrammatic plan view of the embodiment in accordance with FIG. 4, showing the carriage formed from a box profile.

The carriage 4 which may be displaced in the direction indicated by the double-headed arrow 26 is also formed from a box profile, as is clearly evident especially from the diagrammatic representation according to FIG. 7. Here also the conveyor 16 travels through the clear cross-section space, in which case the top run of the conveyor is designated as 43 and the bottom run as 44. The representation in FIG. 7 has the greatest degree of correspondence to that shown in FIG. 3 for the first embodiment. The carriage 4, which may be moved in the longitudinal direction of the machine, grips around the guides 3 for the machine frame with its bearing eyes 41.

The claims defining the invention are as follows:

1. A cutter machine comprising:

a main frame;

guides mounted on said main frame and running in a longitudinal direction of the machine;

a sliding carriage configured in a self-supporting box configuration over said main frame and displaceable along said guides;

a pivoting cutter arm mounted on said carriage;

cutting means rotatably mounted on said pivoting cutter arm; and a loading ramp and a removal conveyor running from a work face of said machine for taking up and conveying away material cut by said cutting means, the removal conveyor being mounted in a clear interior space of the carriage so that the carriage may slide independently of the removal conveyor.

2. The cutter machine according to claim 1, wherein said cutting means is at least one cutting head.

3. The cutter machine according to claim 1, wherein said cutting means is at least one roller.

4. The cutter machine according to claim 1, further comprising pivot arm means for laterally pivoting said cutter arm.

5. The cutter machine according to claim 1, further comprising:

pivot arm means for height pivoting said cutter arm, said pivot arm means being extensible within the clear interior space of the box profile.

6. The cutter machine according to any one of claims 5 or 1–4, said sliding carriage comprising:

a bearing component carrying a bearing for pivoting said cutter arm in a lateral direction, said bearing component being pivotally mounted at lower and upper walls of the carriage.

7. The cutter machine according to claim 1, further comprising:

a bearing component having side walls or surrounding the removal conveyor, said side walls carrying bearings for height pivoting of the cutter arm.

8. The cutter machine according to any one of claims 7 or 1–3, said cutter arm further comprising angled arms, projecting into the clear interior space of the box profile.

9. The cutter machine of according to claim 8, said cutter arm further comprising a hydraulic cylinder-piston aggregate for height pivoting.

10. The cutter machine according to any one of claims 7 or 1–3, further comprising cylinder-piston aggregate means located within the clear interior space of the box profile and extending substantially in the longitudinal direction of the machine for height pivoting and lateral pivoting said cutter arm.

11. The cutter machine according to any one of claims 7 or 1–3, further comprising a framework connecting the guides, said framework including frame components articulated with said guides.

12. The cutter machine according to any one of claims 7 or 1–3, wherein the conveyor in the interior space of the carriage is displaceable to a limited extent in the longitudinal direction of said machine.

13. The cutter machine according to claim 12, wherein the removal conveyor is mounted in a guide in the carriage displaceable in the longitudinal direction of said machine.

14. The cutter machine according to any one of claims 7 or 1–3, wherein the guides comprise bars gripped by the carriage.

15. The cutter machine according to any one of claims 7 or 1–3, further comprising a suction device linked to the clear interior space of the carriage.

16. The cutter machine according to claim 1, further comprising:

pivot arm means for height pivoting said cutter arm, said pivot arm means crossing over within the clear interior space of the box profile.

17. The cutter machine according to claim 1, wherein said pivot arm means is also for laterally pivoting said cutter arm.

* * * * *